US006051545A

United States Patent [19]

Boskamp

[11] Patent Number: 6,051,545

[45] Date of Patent: Apr. 18, 2000

[54] CLEANING COMPOSITIONS

[75] Inventor: Jelles Vincent Boskamp, Vlaardingen, Netherlands

[73] Assignee: Lever Brothers Company Division of Conopco, Inc., New York, N.Y.

[21] Appl. No.: 09/093,631

[22] Filed: Jun. 4, 1998

[30] Foreign Application Priority Data

Jun. 6, 1997 [GB] United Kingdom ..... 9711831

[51] Int. Cl.[7] ..... C11D 17/00; C11D 3/37; C11D 11/00

[52] U.S. Cl. ..... 510/446; 510/224; 510/294; 510/298; 510/470; 510/473

[58] Field of Search ..... 510/446, 224, 510/294, 298, 470, 473

[56] References Cited

U.S. PATENT DOCUMENTS

| | | | |
|---|---|---|---|
| 3,953,350 | 4/1976 | Fujino et al. . | |
| 4,622,161 | 11/1986 | Cornelissens et al. | 510/439 |
| 4,642,197 | 2/1987 | Kruse et al. | 510/298 |
| 4,751,015 | 6/1988 | Humphreys et al. . | |
| 4,818,426 | 4/1989 | Humphreys et al. . | |
| 5,043,091 | 8/1991 | Joshi et al. | 510/294 |
| 5,360,567 | 11/1994 | Fry et al. | 510/298 |

FOREIGN PATENT DOCUMENTS

| | | |
|---|---|---|
| 0 096 680 | 12/1983 | European Pat. Off. . |
| 266863A | 5/1988 | European Pat. Off. . |
| 340013A | 11/1989 | European Pat. Off. . |
| 352135A | 1/1990 | European Pat. Off. . |
| 367339A | 5/1990 | European Pat. Off. . |
| 390251A | 10/1990 | European Pat. Off. . |
| 425277A | 5/1991 | European Pat. Off. . |
| 458397 | 11/1991 | European Pat. Off. . |
| 458398 | 11/1991 | European Pat. Off. . |
| 0 522 766 | 1/1993 | European Pat. Off. . |
| 549272 | 6/1993 | European Pat. Off. . |
| 711827 | 5/1996 | European Pat. Off. . |
| 3417649 | 11/1985 | Germany . |
| 3742043 | 6/1989 | Germany . |
| 60-015500A | 1/1985 | Japan . |
| 62/197497 | 9/1987 | Japan . |
| 02311600 | 12/1990 | Japan . |
| 7-286199 | 10/1995 | Japan . |
| 911204 | 1/1962 | United Kingdom . |
| 2242130 | 9/1991 | United Kingdom . |
| 96/28530 | 9/1996 | WIPO . |

*Primary Examiner*—Lorna M. Douyon
*Attorney, Agent, or Firm*—Rimma Mitelman

[57] ABSTRACT

Cleaning compositions in the form of tablets containing surfactant and detergency builder, especially for use in fabric washing, also contain a water-insoluble, water-swellable polymeric material which has an average particle dimension of at least 400 micrometers. Such material may be cellulosic in nature and promotes disintegration of the tablets in water at the time of use.

15 Claims, No Drawings

CLEANING COMPOSITIONS

FIELD OF THE INVENTION

This invention relates to cleaning compositions in the form of tablets, especially for use in fabric washing, but possibly for use in machine dishwashing.

BACKGROUND OF THE INVENTION AND SUMMARY OF THE PRIOR ART

Detergent compositions in tablet form are described, for example, in GB 911204 (Unilever), U.S. Pat. No. 3,953,350 (Kao), JP 60-015500A (Lion), and EP-A-711827 (Unilever) and are sold commercially in Spain. Tablets for machine dishwashing are described in WO96/28530 (P&G). Tablets have several advantages over powdered products: they do not require measuring and are thus easier to handle and dispense into the washload, and they are more compact, hence facilitating more economical storage.

Tablets of a cleaning composition are generally made by compressing or compacting a quantity of the composition in particulate form. It is desirable that tablets have adequate strength when dry, yet disperse and dissolve quickly when added to wash water.

It is known to include materials whose function is to enhance disintegration of tablets when placed in wash water. Some tablets which are sold commercially incorporate urea for this purpose. Urea has a very high solubility in water exceeding 100 gms per 100 ml water at 20° C.

SUMMARY OF THE INVENTION

We have now found that the distintegration of tablets of cleaning composition can be accelerated by incorporating in the tablet a quantity of a water-insoluble but water-swellable polymeric material.

Surprisingly, we have found that such a material is much more effective if it has a relatively large particle size. Accordingly, the present invention provides a tablet of compacted particulate cleaning composition, wherein the tablet or a discrete region thereof contains surfactant and detergency builder and also contains a water-insoluble, water-swellable polymeric material which has an average particle dimension of at least 400 micrometers, preferably at least 500 micrometers.

Such polymeric material with a particle dimension of at least 400 or 500 micrometers is preferably an agglomerate of smaller particles whose largest dimension is no greater than 150 or 200 micrometers, better no greater than 50 micrometers and at least half of the aggregated particles have a particle dimension of at least 400, preferably at least 700 micrometers.

DETAILED DESCRIPTION AND EMBODIMENTS

The water-swellable, water-insoluble polymeric material may exist as relatively rounded particles, or as relatively flat particles such as flakes or discs. In the latter case a dimension (diameter) of the flakes will be larger, perhaps substantially larger, than the diameter of a sphere with the same volume.

The largest dimension of particles of the polymeric material may be determined by sieve analysis, and the shape of the particles can be observed under a microscope.

Suitable water-swellable polymeric materials preferably have sufficient water-absorptivity that they can absorb at least four times their own weight of water, ie. a water uptake of at least 4 gm per gm.

It is customary to use sodium carboxymethylcellulose (SCMC) in detergent compositions, usually as not more than 3 wt % of the composition. We have found that such quantities of SCMC are generally ineffective to promote tablet disintegration.

We have found it desirable to use materials with little or no ionic character. Such materials may be polysaccharides with little or no ionic substitution.

The absence or near absence of ionic substitution can be expressed by stating that the charge density of the polymeric material is low, such as less than $10^{-3}$, better less than $6\times10^{-4}$ or zero. The term "charge density" denotes the number of charges on a polymer molecule divided by the molecular weight of the polymer. It is essentially the same as the average number of charges on a repeat unit of the polymer divided by the average molecular weight of a repeat unit.

The water-insoluble, water swellable polymeric material is preferably added as particles which contain such material as at least 75% of the anhydrous weight of these particles (i.e. ignoring their moisture content). Usually they will contain little or nothing except the polymer and any accompanying moisture.

A tablet of the invention may be either homogeneous or heterogeneous. In the present specification, the term "homogeneous" is used to mean a tablet produced by compaction of a single particulate composition, but does not imply that all the particles of that composition will necessarily be of identical composition. The term "heterogeneous" is used to mean a tablet consisting of a plurality of discrete regions, for example layers, inserts or coatings, each derived by compaction from a particulate composition. In a heterogenous tablet according to the present invention, each discrete region of the tablet will preferably have a mass of at least 5 gm.

In a heterogeneous tablet, at least one and possibly more of the discrete regions contains the polymeric material together with surfactant and detergency builder in accordance with the invention.

The amount of the polymeric material which is incorporated in a tablet or in a discrete region thereof to promote disintegration in water will generally range from 0.5 to 10 wt % of the tablet or region thereof.

The cleaning composition which is compacted to form a homogenous tablet or a discrete region of a heterogenous tablet may be a composition appropriate for machine dishwashing, in which the quantity of surfactant is usually low (eg. 0.5 to 2 wt %) although higher concentrations ranging up to 10 wt % may be used. Such a composition will typically contain a high proportion of water soluble salts, such as over 60 wt % of the composition, often over 85 wt % of the composition.

One possibility is that the entire tablet, whether homogeneous or heterogeneous, is suitable for machine dishwashing and contains overall between 0.5 and 10 wt % surfactant, and between 5 and 80 or 90 wt % detergency builder, with at least 60 wt % of the composition being water-soluble.

Water soluble salts typically used in machine dishwashing compositions are phosphates (including condensed phosphates) carbonates and silicates, generally as alkali metal salts. Water soluble alkali metal salts selected from phosphates, carbonates and silicates may provide 60 wt % or more of a dishwashing composition.

However, we particularly envisage that a composition which is compacted to form a tablet or discrete region thereof will be suitable for fabric washing, containing at least 2 wt %, better at least 5 wt % of surfactant. In such tablets the surfactant functions as a binder, plasticising the tablet. However, it can also retard disintegration of the tablet by forming a viscous gel when the tablet comes into contact with water.

Thus, a preferred tablet or a discrete region thereof contains from 2 or 5 wt % up to 40 or 50 wt % surfactant, 5 or 10 up to 60 or 80 wt % detergency builder and from 0.5 to 10 wt % of the polymeric material. Where a tablet is heterogenous, these percentage ranges may apply to the overall composition of the tablet, as well as to at least one discrete region of the tablet.

In a heterogenous tablet, the polymeric material may be incorporated in some only of a plurality of discrete regions (eg. in only one of two) while other region(s) contain a lesser concentration, or more, of the polymeric material. Such an arrangement may be used to cause the regions of the tablet to disintegrate and dissolve (in so far as their constituents are soluble) at different rates.

Materials which may be used in tablets of this invention will now be discussed in more detail.

Polymeric Material

As mentioned, this should preferably be nonionic in character and display a high water uptake capacity.

A number of such materials are known, and are generally based on cellulose which may be chemically modified to enhance its water uptake capacity. Sometimes such modified celluloses have ionic substituents but for this invention it is preferred that any substituents are nonionic.

Surfactant Compounds

Compositions which are compacted to form tablets or tablet regions of this invention generally contain one or more detergent surfactants. In a fabric washing composition, these preferably provide from 5 to 50% by weight of the overall tablet composition, more preferably from 8 or 9% by weight of the overall composition up to 40% or 50% by weight. Surfactant may be anionic (soap or non-soap), cationic, zwitterionic, amphoteric, nonionic or a combination of these.

Anionic surfactant may be present in an amount from 0.5 to 50% by weight, preferably from 2% or 4% up to 30% or 40% by weight of the tablet composition.

Synthetic (i.e. non-soap) anionic surfactants are well known to those skilled in the art. Examples include alkylbenzene sulphonates, particularly sodium linear alkylbenzene sulphonates having an alkyl chain length of $C_8$–$C_{15}$; olefin sulphonates; alkane sulphonates; dialkyl sulphosuccinates; and fatty acid ester sulphonates.

Primary alkyl sulphate having the formula $$ROSO_3^-M^+$$

in which R is an alkyl or alkenyl chain of 8 to 18 carbon atoms especially 10 to 14 carbon atoms and $M^+$ is a solubilising cation, is commercially significant as an anionic surfactant. Linear alkyl benzene sulphonate of the formula

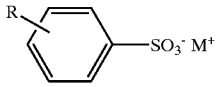

where R is linear alkyl of 8 to 15 carbon atoms and $M^+$ is a solubilising cation, especially sodium, is also a commercially significant anionic surfactant.

Frequently, such linear alkyl benzene sulphonate or primary alkyl sulphate of the formula above, or a mixture thereof will be the desired anionic surfactant and may provide 75 to 100 wt % of any anionic non-soap surfactant in the composition.

In some forms of this invention the amount of non-soap anionic surfactant lies in a range from 5 to 20 wt % of the tablet composition.

It may also be desirable to include one or more soaps of fatty acids. These are preferably sodium soaps derived from naturally occurring fatty acids, for example, the fatty acids from coconut oil, beef tallow, sunflower or hardened rapeseed oil.

Suitable nonionic surfactant compounds which may be used include in particular the reaction products of compounds having a hydrophobic group and a reactive hydrogen atom, for example, aliphatic alcohols, acids, amides or alkyl phenols with alkylene oxides, especially ethylene oxide.

Specific nonionic surfactant compounds are alkyl ($C_{8-22}$) phenol-ethylene oxide condensates, the condensation products of linear or branched aliphatic $C_{8-20}$ primary or secondary alcohols with ethylene oxide, and products made by condensation of ethylene oxide with the reaction products of propylene oxide and ethylene-diamine.

Especially preferred are the primary and secondary alcohol ethoxylates, especially the $C_{9-11}$ and $C_{12-15}$ primary and secondary alcohols ethoxylated with an average of from 5 to 20 moles of ethylene oxide per mole of alcohol.

In certain forms of this invention the amount of nonionic surfactant lies in a range from 4 to 40%, better 4 or 5 to 30% by weight of the composition.

Many nonionic surfactants are liquids. These may be absorbed onto particles of the composition.

In a machine dishwashing tablet the surfactant may be wholly nonionic, in an amount below 5 wt % of the composition, although it is known to include some anionic surfactant and to use up to 10 wt % surfactant in total.

Detergency Builder

A composition which is compacted to form tablets or tablet regions will generally contain from 15 to 80%, more usually 15 to 60% by weight of detergency builder. This may be provided wholly by water soluble materials, or may be provided in large part or even entirely by water-insoluble material with water-softening properties. Water-insoluble detergency builder may be present as 5 to 80 wt %, better 5 to 60 wt % of the composition.

Alkali metal aluminosilicates are strongly favoured as environmentally acceptable water-insoluble builders for fabric washing. Alkali metal (preferably sodium) aluminosilicates may be either crystalline or amorphous or mixtures thereof, having the general formula:

$$0.8\text{–}1.5\ Na_2O.Al_2O_3.\ 0.8\text{–}6\ SiO_2.\ xH_2O$$

These materials contain some bound water (indicated as "xH2O") and are required to have a calcium ion exchange capacity of at least 50 mg CaO/g. The preferred sodium aluminosilicates contain 1.5–3.5 $SiO_2$ units (in the formula above). Both the amorphous and the crystalline materials can be prepared readily by reaction between sodium silicate and sodium aluminate, as amply described in the literature.

Suitable crystalline sodium aluminosilicate ion-exchange detergency builders are described, for example, in GB 1429143 (Procter & Gamble). The preferred sodium aluminosilicates of this type are the well known commercially available zeolites A and X, the novel zeolite P described and claimed in EP 384070 (Unilever) and mixtures thereof.

Conceivably a water-insoluble detergency builder could be a layered sodium silicate as described in U.S. Pat. No.

4,664,839. NaSKS-6 is the trademark for a crystalline layered silicate marketed by Hoechst (commonly abbreviated as "SKS-6"). NaSKS-6 has the delta-$Na_2SiO_5$ morphology form of layered silicate. It can be prepared by methods such as described in DE-A-3,417,649 and DE-A-3,742,043. Other such layered silicates, such as those having the general formula $NaMSi_xO_{2x+1}.yH_2O$ wherein M is sodium or hydrogen, x is a number from 1.9 to 4, preferably 2, and y is a number from 0 to 20, preferably 0 can be used.

Water-soluble phosphorous-containing inorganic detergency builders, include the alkali-metal orthophosphates, metaphosphates, pyrophosphates and polyphosphates. Specific examples of inorganic phosphate builders include sodium and potassium tripolyphosphates, orthophosphates and hexametaphosphates.

Non-phosphorous water-soluble builders may be organic or inorganic. Inorganic builders that may be present include alkali metal (generally sodium) carbonate; while organic builders include polycarboxylate polymers, such as polyacrylates, acrylic/maleic copolymers, and acrylic phosphonates, monomeric polycarboxylates such as citrates, gluconates, oxydisuccinates, glycerol mono- di- and trisuccinates, carboxymethyloxysuccinates, carboxymethyloxymalonates, dipicolinates and hydroxyethyliminodiacetates.

Tablet compositions preferably include polycarboxylate polymers, more especially polyacrylates and acrylic/maleic copolymers which can function as builders and also inhibit unwanted deposition onto fabric from the wash liquor.

Bleach System

Tableted detergent compositions according to the invention may contain a bleach system. This preferably comprises one or more peroxy bleach compounds, for example, inorganic persalts or organic peroxyacids, which may be employed in conjunction with activators to improve bleaching action at low wash temperatures. If any peroxygen compound is present, the amount is likely to lie in a range from 10 to 25% by weight of the composition.

Preferred inorganic persalts are sodium perborate monohydrate and tetrahydrate, and sodium percarbonate, advantageously employed together with an activator. Bleach activators, also referred to as bleach precursors, have been widely disclosed in the art. Preferred examples include peracetic acid precursors, for example, tetraacetylethylene diamine (TAED), now in widespread commercial use in conjunction with sodium perborate; and perbenzoic acid precursors. The quaternary ammonium and phosphonium bleach activators disclosed in U.S. Pat. No. 4,751,015 and U.S. Pat. No. 4,818,426 (Lever Brothers Company) are also of interest. Another type of bleach activator which may be used, but which is not a bleach precursor, is a transition metal catalyst as disclosed in EP-A-458397, EP-A-458398 and EP-A-549272. A bleach system may also include a bleach stabiliser (heavy metal sequestrant) such as ethylenediamine tetramethylene phosphonate and diethylenetriamine pentamethylene phosphonate.

As indicated above, if a bleach is present and is a water-soluble inorganic peroxygen bleach, the amount may well be from 10% to 25% by weight of the composition.

Other Detergent Ingredients

The detergent tablets of the invention may also contain one of the detergency enzymes well known in the art for their ability to degrade and aid in the removal of various soils and stains. Suitable enzymes include the various proteases, cellulases, lipases, amylases, and mixtures thereof, which are designed to remove a variety of soils and stains from fabrics. Examples of suitable proteases are Maxatase (Trade Mark), as supplied by Gist-Brocades Nev., Delft, Holland, and Alcalase (Trade Mark), and Savinase (Trade Mark), as supplied by Novo Industri A/S, Copenhagen, Denmark. Detergency enzymes are commonly employed in the form of granules or marumes, optionally with a protective coating, in amount of from about 0.1% to about 3.0% by weight of the composition; and these granules or marumes present no problems with respect to compaction to form a tablet.

The detergent tablets of the invention may also contain a fluorescer (optical brightener), for example, Tinopal (Trade Mark) DMS or Tinopal CBS available from Ciba-Geigy AG, Basel, Switzerland. Tinopal DMS is disodium 4,4' bis-(2-morpholino-4-anilino-s-triazin-6-ylamino) stilbene disulphonate; and Tinopal CBS is disodium 2,2'-bis-(phenylstyryl) disulphonate.

An antifoam material is advantageously included, especially if a detergent tablet is primarily intended for use in front-loading drum-type automatic washing machines. Suitable antifoam materials are usually in granular form, such as those described in EP 266863A (Unilever). Such antifoam granules typically comprise a mixture of silicone oil, petroleum jelly, hydrophobic silica and alkyl phosphate as antifoam active material, sorbed onto a porous absorbed water-soluble carbonate-based inorganic carrier material. Antifoam granules may be present in an amount up to 5% by weight of the composition.

It may also be desirable that a detergent tablet of the invention includes an amount of an alkali metal silicate, particularly sodium ortho-, meta- or disilicate. The presence of such alkali metal silicates at levels, for example, of 0.1 to 10 wt %, may be advantageous in providing protection against the corrosion of metal parts in washing machines, besides providing some measure of building and giving processing benefits in manufacture of the particulate material which is compacted into tablets.

A composition for fabric washing will generally not contain more than 15 wt % silicate. A composition for machine dishwashing will often contain more than 20 wt % silicate.

Further ingredients which can optionally be employed in fabric washing detergent tablet of the invention include anti-redeposition agents such as sodium carboxymethylcellulose, straight-chain polyvinyl pyrrolidone and the cellulose ethers such as methyl cellulose and ethyl hydroxyethyl cellulose, fabric-softening agents; heavy metal sequestrants such as EDTA; perfumes; and colorants or coloured speckles.

Particle Size and Distribution

A detergent tablet of this invention, or a discrete region of such a tablet, is a matrix of compacted particles.

Preferably the particulate composition has an average particle size in the range from 200 to 2000 $\mu$m, more preferably from 250 to 1400 $\mu$m. Fine particles, smaller than 180 $\mu$m or 200 $\mu$m may be eliminated by sieving before tableting, if desired, although we have observed that this is not always essential.

While the starting particulate composition may in principle have any bulk density, the present invention is especially relevant to tablets made by compacting powders of relatively high bulk density, because of their greater tendency to exhibit disintegration and dispersion problems. Such tablets have the advantage that, as compared with a tablet derived from a low bulk density powder, a given dose of composition can be presented as a smaller tablet.

Thus the starting particulate composition may suitably have a bulk density of at least 400 g/liter, preferably at least 500 g/liter, and perhaps at least 600 g/liter.

Granular detergent compositions of high bulk density prepared by granulation and densification in a high-speed mixer/granulator, as described and claimed in EP 340013A (Unilever), EP 352135A (Unilever), and EP 425277A (Unilever), or by the continuous granulation/densification processes described and claimed in EP 367339A (Unilever) and EP 390251A (Unilever), are inherently suitable for use in the present invention.

Preferably, separate particles of water-insoluble, water-swellable polymeric material are mixed with the remainder of the particulate composition prior to compaction into tablets.

Tableting

Tableting entails compaction of the particulate composition. A variety of tableting machinery is known, and can be used. Generally it will function by stamping a quantity of the particulate composition which is confined in a die.

Tableting may be carried out at ambient temperature or at a temperature above ambient which may allow adequate strength to be achieved with less applied pressure during compaction. In order to carry out the tableting at a temperature which is above ambient, the particulate composition is preferably supplied to the tableting machinery at an elevated temperature. This will of course supply heat to the tableting machinery, but the machinery may be heated in some other way also.

If any heat is supplied, it is envisaged that this will be supplied conventionally, such as by passing the particulate composition through an oven, rather than by any application of microwave energy.

The size of a tablet will suitably range from 10 to 160 grams, preferably from 15 to 60 g, depending on the conditions of intended use, and whether it represents a dose for an average load in a fabric washing or dishwashing machine or a fractional part of such a dose. The tablets may be of any shape. However, for ease of packaging they are preferably blocks of substantially uniform cross-section, such as cylinders or cuboids. The overall density of a tablet preferably lies in a range from 1040 or 1050 gm/liter up to 1300 gm/liter. The tablet density may well lie in a range up to no more than 1250 or even 1200 gm/liter.

EXAMPLES

Example 1

Experiments were carried out with a polymeric material derived from cellulose and marketed by Rettenmaier GmbH as "Arbocel A1". As supplied it has a range of shapes and particle sizes (as determined by sieve analysis) with an average diameter of 1 mm. It was found to have a water-uptake of 5.7 gm/gm.

The material was mixed, at a concentration of 5% by weight with each of four detergent powders. These powders were then stamped into detergent tablets with a weight of 40 g. Control tablets were made from the same powders without Arbocel A1. The main constituents of these powders are given in the table below.

Some tablets made from each of the four powders were fully immersed in water at 20° C. The tablets containing Arbocel were observed to break up in times less than one minute. The control tablets remained intact for ten minutes or more.

For some of the tablets the break-up, dispersion and dissolution of tablets was measured by a test procedure in which a tablet is placed on a plastic sieve with 2 mm mesh size which was immersed in 9 liters of demineralised water at ambient temperature of 20° C. The water conductivity was monitored until it reached a constant value. The time for dissolution of the tablets was taken as the time ($T_{90}$) for change in the water conductivity to reach 90% of its final magnitude. The results are included in the table below.

| | | Visible disintegration | | $T_{90}$ conductivity measurement | |
|---|---|---|---|---|---|
| Composition of Powder | Powder bulk density | without Arbocel A1 | with Arbocel A1 | without Arbocel A1 | with Arbocel A1 |
| A | | | | | |
| 16 wt % total surfactant, 46% sodium tripolyphosphate | 640 gm/liter | >10 minutes | <1 minute | 4 minutes | 2 minutes |
| B | | | | | |
| 16 wt % total surfactant, 31% zeolite, zero phosphate | 880 gm/liter | >10 minutes | <1 minute | over 10 minutes | 2 minutes |
| C | | | | | |
| 19 wt % total surfactant, 15% zeolite, 10% layered silicate, zero phosphate | | >10 minutes | <1 minute | over 10 minutes | 4 minutes |
| D | | | | | |
| spray dried: 9% total surfactant, 35% sodium tripolyphosphate | about 550 gm/liter | >10 minutes | <1 minute | | |

In comparative experiments, tablets were made using 5% of Arbocel A1 which had been gently ground with a pestle and mortar to reduce the size of the particles, (to the primary particle size of approximately 120 micrometers). This ground material was much less effective at promoting tablet disintegration.

Example 2

A detergent powder containing about 12 wt % primary alkyl sulphate as anionic surfactant and about 25 wt % of zeolite A24 as detergency builder, was used.

Some powder was mixed with 5% by weight of Arbocel A1 and made into tablets. Some powder was used to make control tablets without Arbocel.

The strength of these tablets was measured using an Instron universal testing machine to compress a tablet until fracture. The value of diametral fracture stress (DFS) was then calculated using the equation $$\sigma = \frac{2P}{\pi D t}$$

where σ is the diametral fracture stress in Pascals, P is the applied load in Newtons to cause fracture, D is the tablet diameter in meters and t is the tablet thickness in meters.

The tablets with Arbocel A1 and the control tablets were made with equal strength. This required about 30% higher compaction pressure for the tablets without Arbocel A1. When immersed in water at 20° C. to test dissolution time, as in the previous Example, the tablets containing Arbocel A1 reached 90% of maximum conductivity within 3 minutes. The control tablets without Arbocel had not reached 90% maximum conductivity after 20 minutes.

Example 3

Tablets for use in fabric washing were made, starting with a spray-dried base powder of the following composition:

| Ingredient | Parts by Weight |
|---|---|
| Sodium linear alkylbenzene sulphonate | 1.0 |
| Sodium tripolyphosphate* | 16.8 |
| $C_{13-15}$ fatty alcohol 7EO | 2.4 |
| $C_{13-15}$ fatty alcohol 3EO | 2.3 |
| Sodium silicate | 4.0 |
| Soap | 0.21 |
| Acrylate/maleate copolymer | 1.5 |
| Sodium sulphate, moisture and minor ingredients | balance to 45 |

*Added to the slurry as anhydrous sodium tripolyphosphate containing at least 70% phase II form.

A number of particulate compositions were made by mixing this powder with other ingredients as tabulated below. These included particles of sodium tripolyphosphate specified to contain 70% phase I form and contain 3.5% water of hydration (Rhodia-Phos HPA 3.5 available from Rhone-Poulenc).

The added ingredients also included particles of water-insoluble water-swellable polymeric material. This material was as "Arbocel A1" as in Example 1. For some compositions this material was sieved to provide a fraction with a narrower range of particle size.

The various compositions contained the following percentages by weight:

| Ingredient | % by weight |
|---|---|
| Base powder | 45.0 |
| Sodium percarbonate granules | 15.0 |
| TAED granules | 3.4 |
| Anti-foam granules | 3.2 |
| Perfume, enzymes and other minor ingredients | 3.5 |
| HPA tripolyphosphate | 15 |
| Water-swellable polymer | 3 or 5 |
| Sodium carbonate | 10 or 12 |

40 g portions of each composition were made into cylindrical tablets of 44 mm diameter, using a Fette pilot plant press, with a fixed level of applied pressure so as to produce tablets with density in a range from 1100 to 1250 kg/m$^3$. The strength of these tablets was measured as in Example 2.

The percentages of polymeric material and its particle size, together with the DFS values and conductivity results are set out in the following table:

| | polymeric material | | carbonate | DFS | $T_{90}$ |
|---|---|---|---|---|---|
| # | weight % | particle diameter | weight % | (kPa) | (minutes) |
| 3A | 5% | below 470$\mu$ | 10% | 24.6 | 5.5 |
| 3B | 5% | 470–800$\mu$ | 10% | 30 | 3.2 |
| 3C | 5% | 800–1400$\mu$ | 10% | 21 | 1.4 |
| 3D | 3% | 800–1400$\mu$ | 12% | 33 | 2.8 |

Example 4

The procedure of Example 1 was repeated using powder C from Example 1 and a Sepharose 6B, a nonionic polysaccharide. The polysaccharide was used in the form of small lumps, and enhanced disintegration when the tablets were placed in water.

Example 5

Tablets were prepared as in Example 3, using the same spray dried base powder, but different added ingredients, as set out in the following table:

| Ingredient | % by weight | | |
|---|---|---|---|
| Base powder | 45.0 | 54.0 | 58.0 |
| Polyvinylpyrrolidone | — | — | 0.6 |
| SKS-6 Layered silicate | — | 13.4 | — |
| Anti-foam granules | 3.1 | 2.5 | 4.2 |
| Perfume, enzymes and other minor ingredients | | | 2.0 |
| Sodium citrate dihydrate | — | — | 20.0 |
| Water-swellable polymer | 5.0 | 5.0 | 5.0 |
| Sodium carbonate | balance to 100% | | |

Example 6

Tablets for use in fabric washing were made, starting with a granulated base powder of the following composition:

| Ingredient | parts by weight |
|---|---|
| Sodium linear alkylbenzene sulphonate | 7.7 |
| $C_{13-15}$ fatty alcohol 7EO. | 3.5 |
| $C_{13-15}$ fatty alcohol 3EO. | 3.7 |
| Zeolite A24 | 25.2 |
| Sodium citrate dihydrate | 2.6 |
| Sodium sulphate, moisture and minors | balance to 50 |

This powder was then mixed with further ingredients to form particulate compositions which were then compacted into tablets of weight 40 g as in previous examples. These compositions were as follows:

| Ingredient | % by weight | | |
|---|---|---|---|
| Base powder | 50.0 | 50.0 | 67.0 |
| Sodium perborate monohydrate | 14.3 | 14.3 | — |
| TAED granules | 5.5 | 5.5 | — |
| Anti-foam granules | 1.0 | 1.0 | 2.0 |
| Fluorescer granules | 1.0 | 1.0 | — |
| Sodium silicate granules | 3.7 | 3.7 | — |
| Acrylate/maleate copolymer | 1.0 | 1.0 | 1.8 |
| SKS-6 layered silicate | — | 18 | |
| Sodium carbonate | — | — | 3.2 |
| Water-swellable polymer | 3.0 | 3.0 | 3.0 |
| Sodium citrate dihydrate | 18 | — | 20 |
| Perfume, enzymes and other minor ingredients | 2.5 | 2.5 | 3.0 |
| TOTAL | 100 | 100 | 100 |

I claim:

1. A tablet of compacted particulate cleaning composition, wherein the tablet or a discrete region thereof contains surfactant and detergency builder and also contains a water-insoluble, water-swellable polymeric material which has an average particle dimension of at least 500 micrometers to about 1400 micrometers, wherein the polymeic material is substantially nonionic such that the charge density of the polymeric material does not exceed $10^{-3}$.

2. A tablet according to claim 1, wherein the polymeric material comprises aggregates of particles with a particle dimension no greater than 200 micrometers, and at least half of the aggregated particles have a particle dimension of at least 700, micrometers.

3. A tablet according to claim 1, wherein the polymeric material is a polysaccharide.

4. A tablet according to claim 3, wherein the polysaccharide comprises aggregates of particles with a particle dimension no greater than 200 micrometers, at least half of the aggregated particles having a particle dimension of at least 700 micrometers.

5. A tablet according to claim 1, wherein the tablet or discrete region thereof comprises 0.5 to 50 wt % surfactant, 5 to 80 wt % detergency builder, and 0.5 to 10 wt % of the polymeric material, by weight of the tablet or region thereof.

6. A tablet according to claim 5, wherein the tablet or said discrete region thereof comprises 2 to 50 wt % surfactant, 5 to 80 wt % detergency builder, and 0.5 to 10 wt % of the polymeric material, by weight of the tablet or region thereof.

7. A tablet according to claim 5 wherein said detergency builder comprises water-insoluble detergency builder in an amount from 5 to 60% by weight of the tablet or said region thereof.

8. A tablet according to claim 1, which tablet contains a plurality of discrete regions at least one of which contains a quantity of the polymeric material while at least one other region of the tablet contains a lesser concentration of the polymeric material or none at all.

9. A tablet according to claim 8, which has at least two layers, the composition in at least one layer containing surfactant, detergency builder and the polymeric material, while at least one other layer contains a lesser concentration of the polymeric material or none at all.

10. A tablet according to claim 1, which overall contains from 5 to 50% by weight of surfactant and 5 to 80% by weight of detergency builder.

11. A tablet according to claim 10, which overall contains 5 to 60% by weight water-insoluble detergency builder.

12. A tablet according to claim 10, which overall contains from 10 to 80% by weight of water-soluble detergency builder.

13. A tablet according to claim 1, which overall contains from 5 to 50% by weight of surfactant and from 5 to 80% by weight of detergency builder and wherein the polymeric material is a polysaccharide which comprises aggregates of particles such that at least half of the aggregated particles have a particle dimension of at least 700 micrometers.

14. Process for making a detergent tablet as claimed in claim 1, which comprises mixing water-insoluble, water-swellable polymeric material with the surfactant and detergency builder so as to form a particulate cleaning composition and compacting a quantity of the particulate composition in a mould so that it forms a tablet or a region of a tablet.

15. Process according to claim 14 wherein the swellable polymeric material is added as particles which contain at least 75% of their own weight of the polymeric material.

* * * * *